US006163942A

United States Patent [19]

Liao

[11] Patent Number: 6,163,942

[45] Date of Patent: Dec. 26, 2000

[54] TWO-PIECE LOCK WITH HIDDEN LOCKING MECHANISM

[76] Inventor: Chien-Chen Liao, No. 101, Lane 587, Wen Lin Rd., Shih Lin Taipei, Taiwan

[21] Appl. No.: 09/338,497

[22] Filed: Jun. 23, 1999

[51] Int. Cl.[7] ..... A44B 17/00

[52] U.S. Cl. ..... 24/625; 24/614; 24/589; 24/613; 24/605

[58] Field of Search ..... 24/589, 605, 1, 24/607, 612, 616, 613, 614, 615, 618, 625, 265 WS, 265 B

[56] References Cited

U.S. PATENT DOCUMENTS

| | | |
|---|---|---|
| 1,817,475 | 8/1931 | Becker . |
| 2,399,667 | 5/1946 | Fikuart . |
| 3,433,436 | 3/1969 | Mattey . |
| 3,712,173 | 1/1973 | Savioli et al. . |
| 3,744,102 | 7/1973 | Gaylord . |
| 4,110,874 | 9/1978 | Gaylord . |
| 6,014,793 | 1/2000 | Howald . |

*Primary Examiner*—James R. Brittain

*Attorney, Agent, or Firm*—Dougherty & Troxell

[57] ABSTRACT

A two-piece lock comprises a male connector; a locking mechanism provided on the male connector including a pair of connecting rods each having a rod portion and a slope portion, a pair of springs each putting on one of the rod portions, a tube member for receiving the springs and the rod portions on two opposite sides having a longitudinal center opening and a transverse center hole, a movable member having a head portion and a recessed body portion, and a pair of connecting members each pivotably connecting the rod portions and the recessed body portion which is pivotably secured to the tube member by inserting a fixing means through the transverse center hole and a predetermined position of the recessed body portion; and a female connector comprising a pair of holes on two opposite sides each receiving one of the slope portions in a locked position, and a recessed portion for receiving the head portion. As such, the locking mechanism is only seen by the head portion of the movable member for achieving a hidden safety mechanism. Further, the safety mechanism is enhanced by requiring to apply a predetermined force to slide the head portion of the movable member toward a predetermined direction prior to opening the lock.

7 Claims, 6 Drawing Sheets

TWO-PIECE LOCK WITH HIDDEN LOCKING MECHANISM

BACKGROUND OF THE INVENTION

1. Field of the Invention

The present invention relates to a two-piece lock, and more particularly to a two-piece lock with hidden locking mechanism in order to form a safety device.

2. Description of Related Art

A first prior art two-piece lock is shown in FIG. 1. The safety mechanism is achieved by inserting a male connector 101 into a female connector 102 such that a pair of flexible projections 111 are locked in a pair of corresponding cavities 112. However, the flexible projections 111 are subject to be pressed inward incidentally because part of it is exposed to outside. The safety mechanism becomes neutralized if such occurs.

A second prior art two-piece lock is shown in FIG. 2. Similarly, the safety mechanism is substantially achieved by inserting the male connector 101 into the female connector 102 such that the pair of flexible projections 111 are locked in the pair of corresponding cavities 112. Further, the safety mechanism is enhanced by providing an elastic raised member 121 and a hole 122 which are interlocked when the male connector 101 is inserted into the female connector 102. However, the flexible projections 111 and the elastic raised member 121 are subject to be pressed inward incidentally because part of them are exposed to outside. The safety mechanism also becomes neutralized if such occurs.

A third prior art two-piece lock is shown in FIG. 3. The safety mechanism is substantially achieved by inserting the male connector 101 into the female connector 102 such that the pair of flexible projections 111 are locked in the pair of corresponding cavities 112. Further, the safety mechanism is enhanced by providing a projection 131 and an elastic button 132 which are interlocked when the male connector 101 is inserted into the female connector 102. However, the flexible projections 111 and the elastic button 132 are subject to be pressed inward incidentally because part of them are exposed to outside. The safety mechanism again becomes neutralized if such occurs.

Thus, it is desirable to provide an improved two-piece lock with hidden locking mechanism in order to overcome the above drawbacks of prior art.

SUMMARY OF THE INVENTION

It is an object of the present invention to provide a two-piece lock comprising a male connector; a locking mechanism provided on the male connector including a pair of connecting rods each having a rod portion and a sloped portion, a pair of springs each placed on one of the rod portions, a tube member for receiving the springs and the rod portions on two opposite sides having a longitudinal center opening and a transverse center hole, a movable member having a head portion and a recessed body portion, and a pair of connecting members each pivotally connecting the rod portions and the recessed body portion which is further pivotally secured to the tube member by inserting a fixing means through the transverse center hole and a predetermined position of the recessed body portion; and a female connector comprising a pair of holes on two opposite sides each receiving one of the sloped portions in a locked position, and a recessed portion for receiving the head portion. As such, the locking mechanism is only seen by the head portion of the movable member for achieving a hidden safety mechanism. Further, the safety mechanism is enhanced by requiring a predetermined force to slide the head portion of the movable member toward a predetermined direction prior to opening the lock.

The above and other objects, features and advantages of the present invention will become apparent from the following detailed description taken with the accompanying drawings.

DETAILED DESCRIPTION OF THE PREFERRED EMBODIMENTS

Figure 1A:
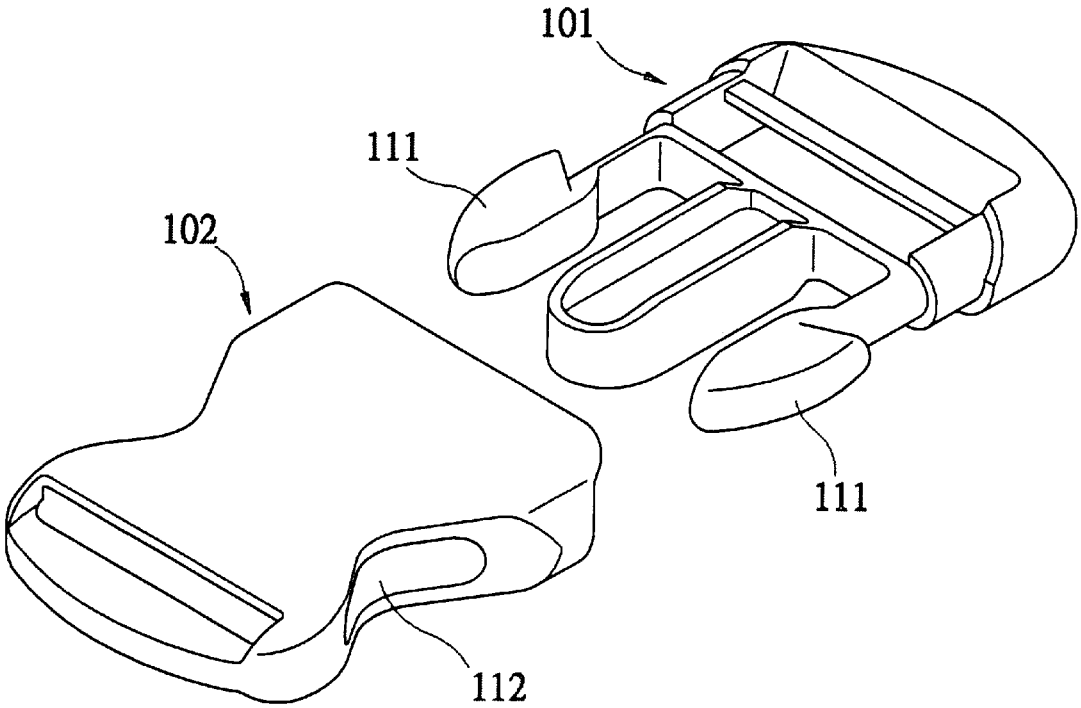
FIG. 1A(PRIOR ART)
FIGS. 1A–1C are perspective views of a first, a second, and a third prior art two-piece locks respectively.
Figure 1B:
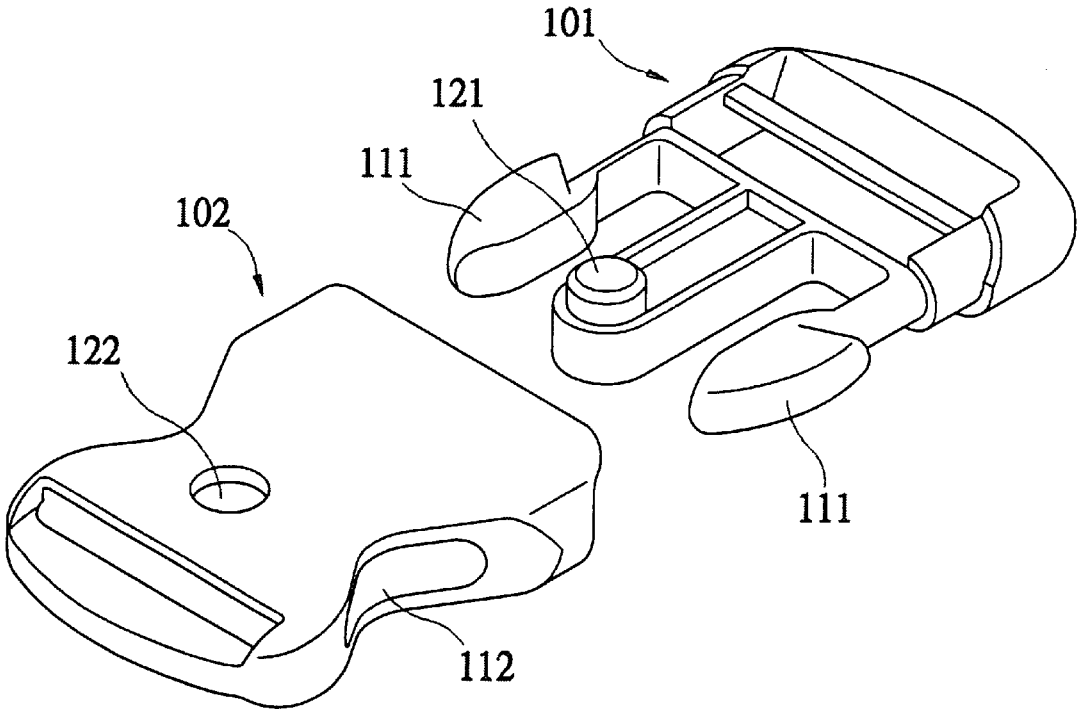
FIG. 1B(PRIOR ART)
Figure 1C:
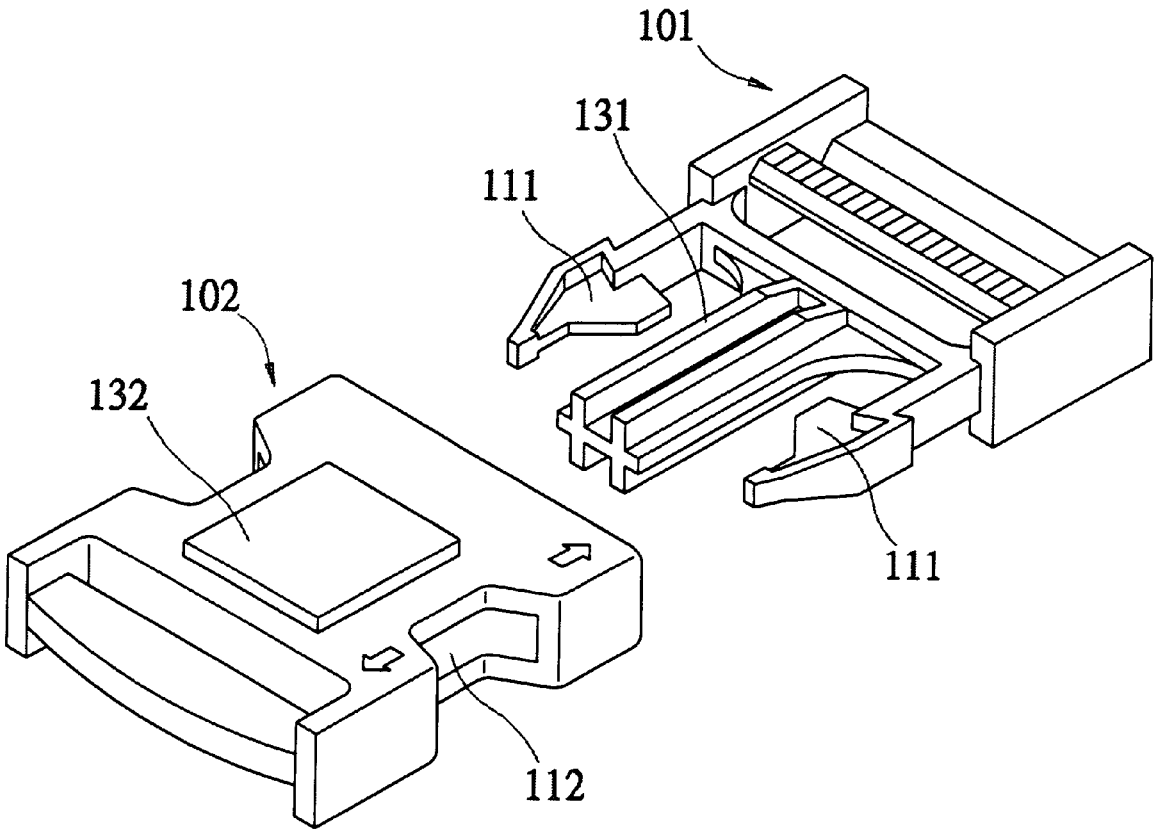
FIG. 1C(PRIOR ART)
Figure 2:
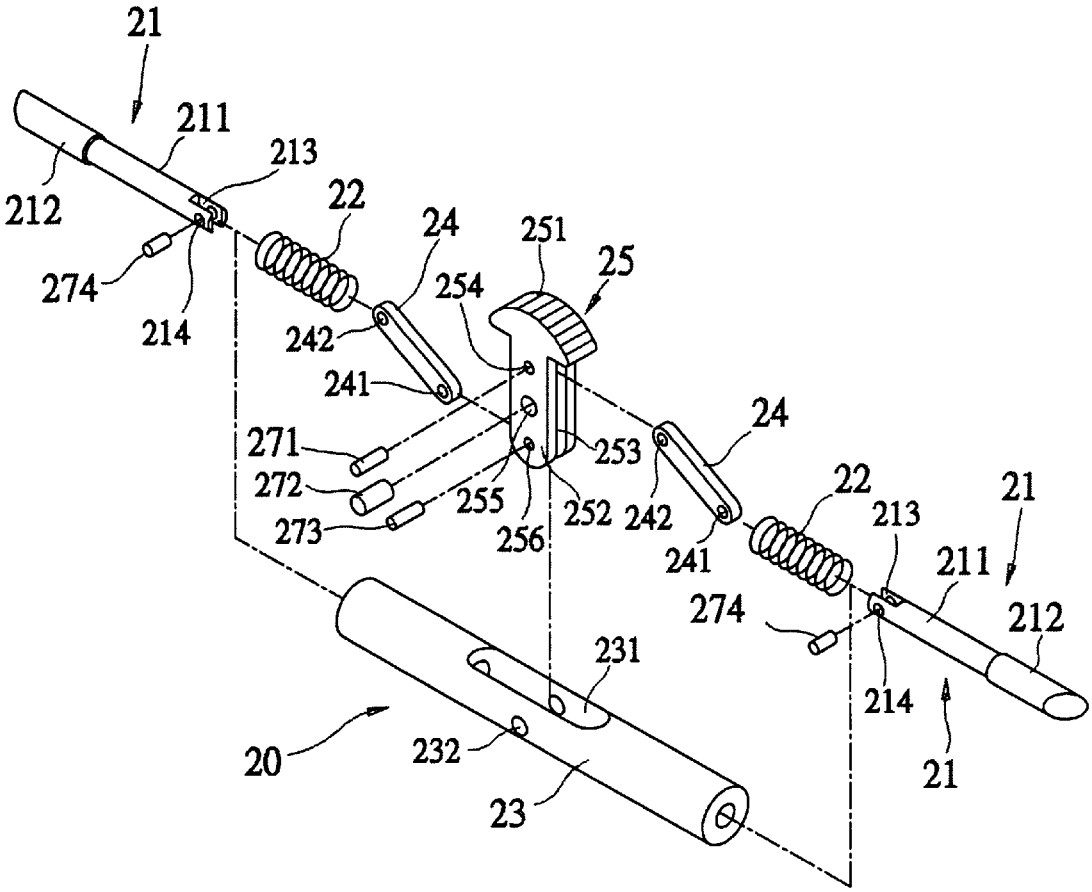
FIG. 2 is an exploded view of a locking mechanism of the present invention.

Referring to FIG. 2, there is shown an exploded view of a locking mechanism 20 constructed according to the invention. The locking mechanism 20 includes a pair of connecting rods 21 each having a rod portion 211 and a sloped portion 212, a pair of springs 22, a tube member 23 having a center opening 231 and a center hole 232, a pair of connecting members 24, and a movable member 25. The rod portion 211 has a receiving space 213 and a hole 214 both on the left end. The connecting member 24 has a first hole 241 on one side and a second hole 242 on the opposite side. The movable member 25 comprises a head portion 251 and a body portion 252 having a receiving space 253 and three holes 254, 255, and 256.

The assembly of the locking mechanism 2 is described as follows.

Figure 3:
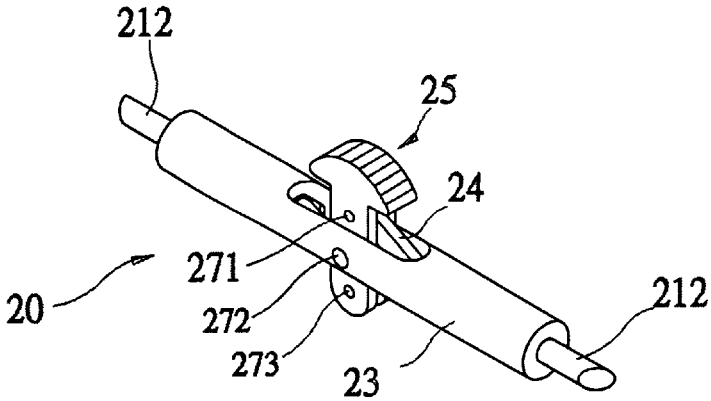
FIG. 3 is a perspective view of the locking mechanism of FIG. 2.

As to the components on the right side such as the connecting rod 21, the spring 22, and the connecting member 24, firstly, place the spring 22 on the rod portion 21. Then, put the right end of the connecting member 24 into the receiving space 213, and use a rivet 274 to fasten the connecting member 24 and the connecting rod 21 together by inserting through the hole 214,the first hole 241, and the receiving space 213. Then, insert the connected connecting rod 21, the spring 22, and the connecting member 24 into the tube member 23 from the right end thereof until the second hole 242 located substantially on the center of the opening 231. Note that until this stage the assembly of components on the left side of the movable member 25 is the same as that on the right side of the movable member 25. Thus, a detailed description thereof will be omitted herein for the sake of brevity. Then, insert the movable member 25 into the opening 231 with the hole 255 of the movable member 25 disposed correspondingly to the hole 232 of the opening 231. Then, use a rivet 271 to fasten the right connecting member 24 and the movable member 25 together by inserting through the hole 254 and the second hole 242 of the right connecting member 24. Then, use a rivet 272 to fasten the tube member 23 and the movable member 25 together by inserting through the hole 232 and the hole 255. Finally, use a rivet 273 to fasten the left connecting member 24 and the movable member 25 together by inserting through the hole 256 and the first hole 241 of the left connecting member 24 to form an assembled locking mechanism 20 as shown in FIG. 3. The connecting members 24 are pivotable on the rivets 271 and 273 within the receiving space 253 in a limited range, while the movable member 25 is pivotable on the rivet 272 in another limited range.

Figure 4:
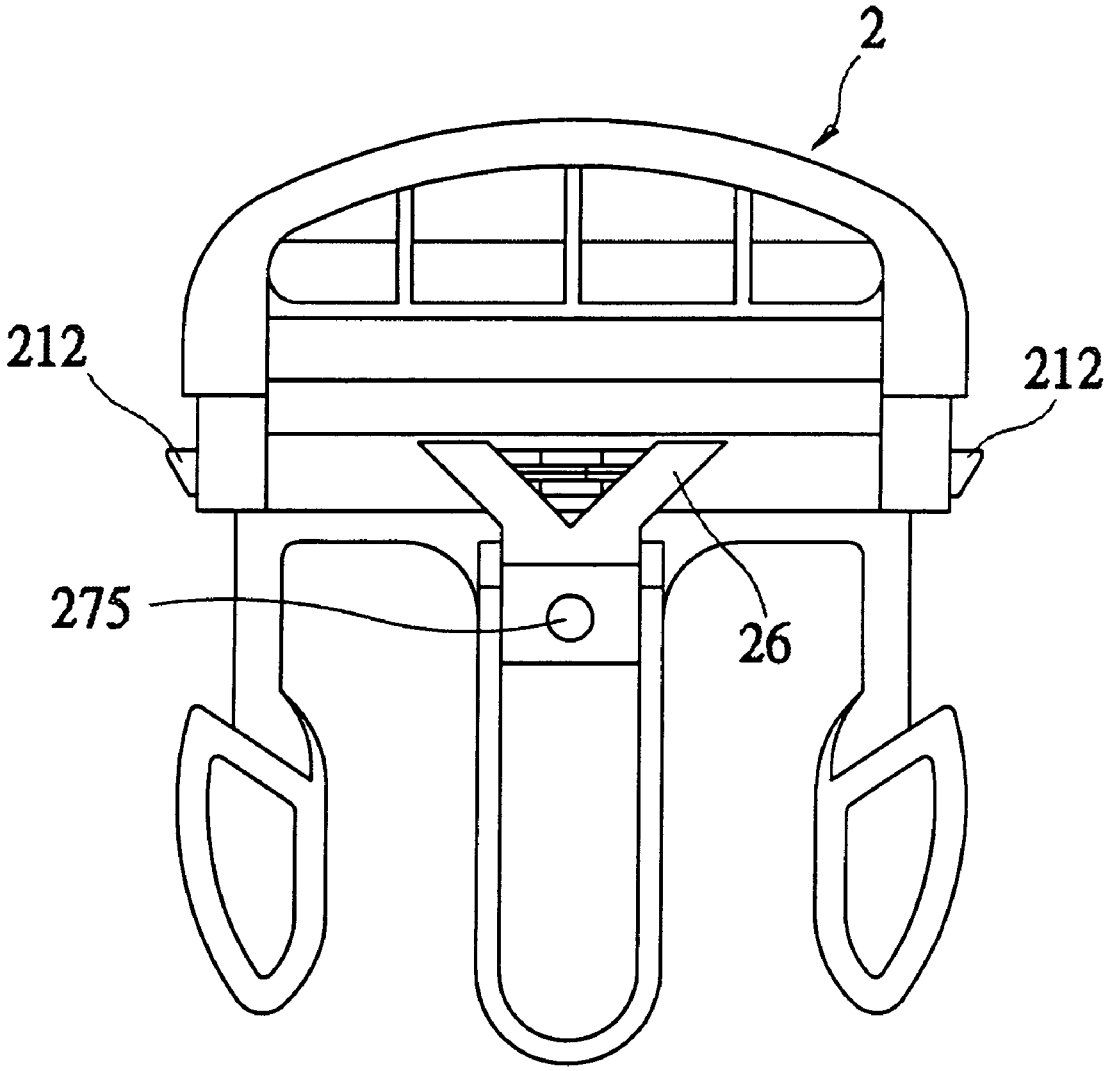
FIG. 4 is a bottom plan view of a male connector of the present invention.

In FIG. 4, a flexible Y-shaped projection 26 is fixed to the center of a male connector 2 by a rivet 275. Such that the projection 26 can acts as enhancing the safety mechanism.

Figure 5:
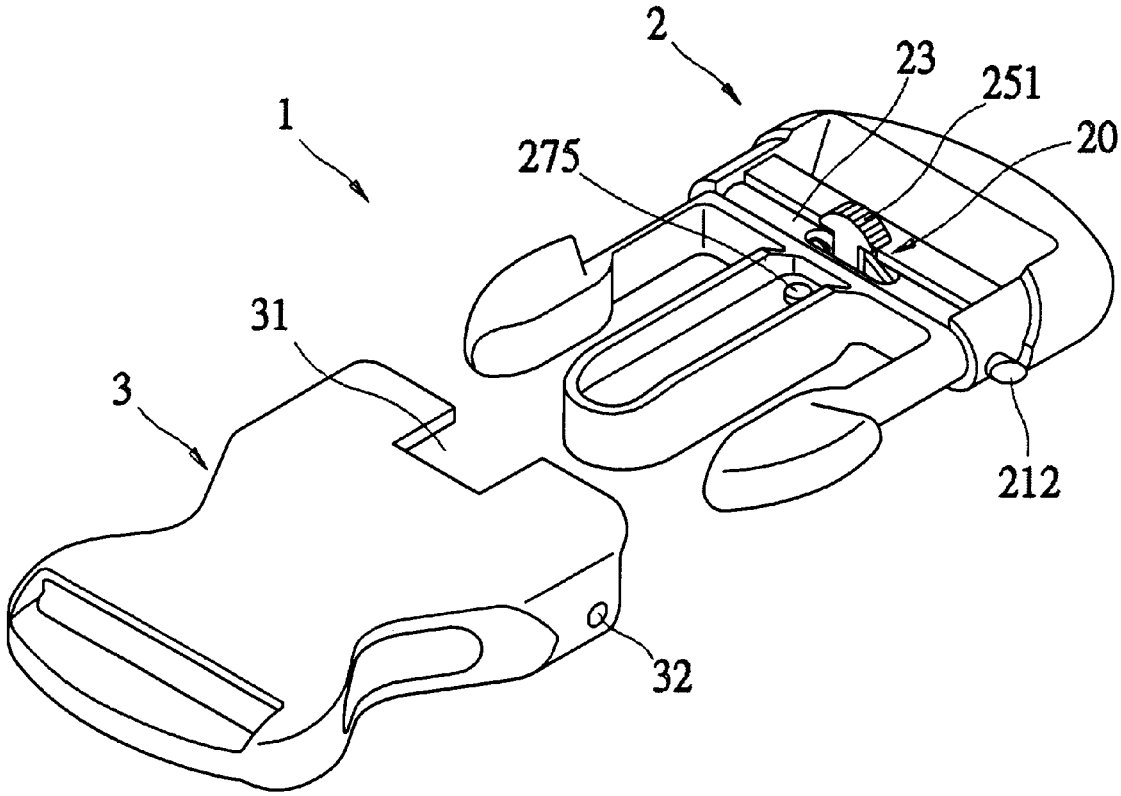
FIG. 5 a perspective view of the present invention in which the male connector is separated from a female connector.
Figure 6:
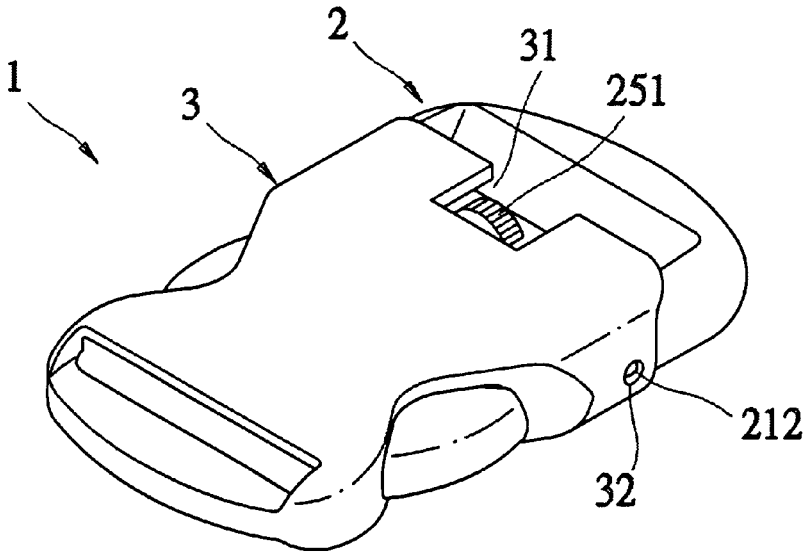
FIG. 6 is another perspective view of the present invention in which the male connector is inserted into the female connector.

A two-piece lock 1 of the invention comprising the male connector 2 and a female connector 3 is illustrated in FIG. 5 in which the male connector 2 is separated from the female connector 3, i.e., prior to being locked. The female connector 3 comprises a pair of holes 32 (only one is shown) on two opposite sides and a recessed portion 31. It is seen that the slope portion 212 is extended a predetermined distance from the surface of the male connector 2. Note that the sloped portions 212 are movable within the tube member 23 by the expansion and compression of the spring 22, or by exerting a force on the sloped portions 212. As such, the sloped portions 212 are received within the holes 32 when the male connector 2 is inserted into the female connector 3 to form the locked twopiece lock 1 as illustrated in FIG. 6. Note that only the head portion 251 is seen from outside, i.e., received in the recessed portion 31, while all other components of the locking mechanism 20 are hidden within the lock 1.

Figure 7:
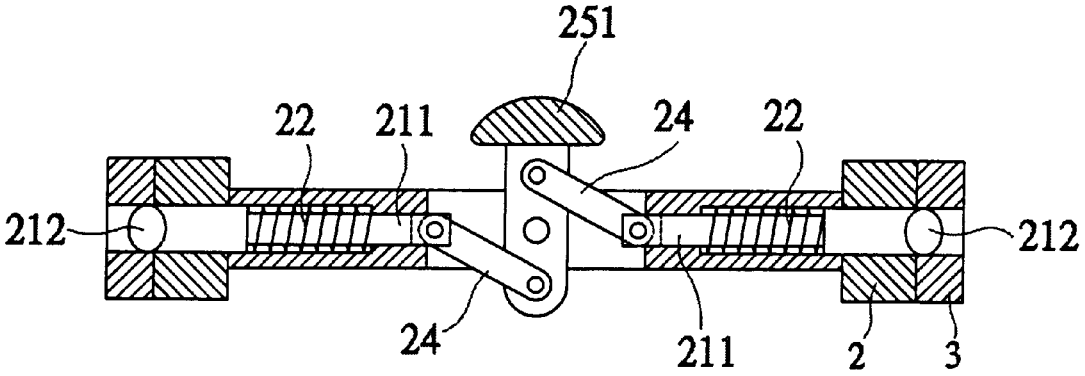
FIGS. 7–8 are cross-sectional views of the locking mechanism and part of the female connector for showing a locked and an open positions respectively.

The locked locking mechanism 20 is illustrated in FIG. 7. It is seen that the movable member 25 is on an upright position. Further, the top end of the sloped portions 212 are in the join of the male connector 2 and female connector 3.

Figure 8:
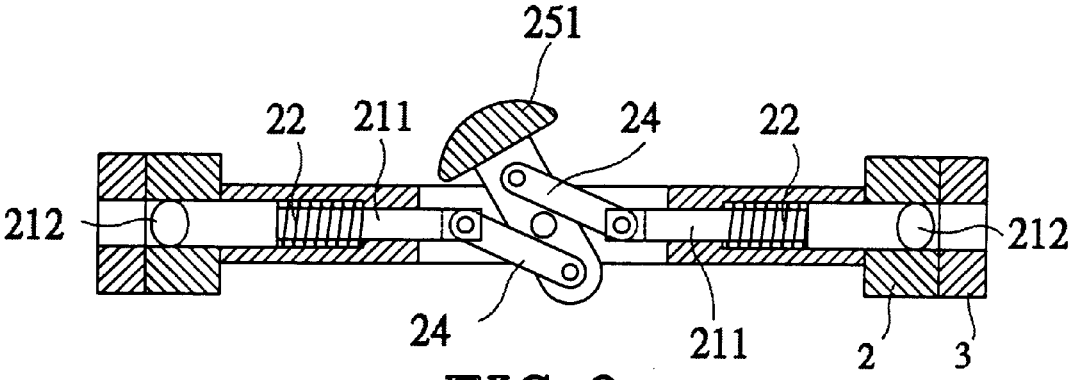

It is required to apply a predetermined force in order to slide the head portion 251. Then, the right connecting member 240 extends to left, while the left connecting member 240 extends to right which in turn compress the springs 22 to force the rod portions 211 and the slope portions 212 move inwardly. As such, the slope portions 212 are completely received within the male connector 2 as shown in FIG. 8. Finally, pull the male connector 2 out of the female connector 3 in order to open the lock 1.

While the invention herein disclosed has been described by means of specific embodiments, numerous modifications and variations could be made thereto by those skilled in the art without departing from the scope of the invention set forth in the claims.

What is claimed is:

1. A lock comprising a male connector, a locking mechanism provided on the male connector including a pair of connecting rods each having a rod portion and a sloped portion, a pair of springs each placed on one of the rod portions, a tube member for receiving the springs and the rod portions on two opposite sides having a longitudinal center opening and a transverse center hole, a movable member having a head portion and a recessed body portion, and a pair of connecting members each pivotally connecting the rod portions and the recessed body portion by a first fixing means; and a female connector comprising a pair of holes on two opposite sides each receiving one of the sloped portions in a locked position, and a recessed portion for receiving the head portion;

wherein the recessed body portion is pivotally secured to the tube member by inserting a second fixing means through the transverse center hole and a predetermined position of the recessed body portion.

2. The lock of claim 1, wherein the sloped portions are received within the male connector in an open position.

3. The lock of claim 1, wherein the predetermined position is a center of the recessed body portion.

4. The lock of claim 1, wherein the first fixing means is a rivet.

5. The lock of claim 1, wherein the second fixing means is a rivet.

6. The lock of claim 1, wherein the head portion is only allowed to move toward a predetermined direction when a predetermined force is applied on it prior to opening the lock.

7. The lock of claim 6, wherein the predetermined direction is from right to left.

* * * * *